United States Patent [19]

Umeda

[11] Patent Number: 4,487,148

[45] Date of Patent: Dec. 11, 1984

[54] SAILBOAT

[75] Inventor: Kazuhiro Umeda, Tokyo, Japan

[73] Assignee: U.M. Corporation, Tokyo, Japan

[21] Appl. No.: 426,049

[22] Filed: Sep. 28, 1982

[30] Foreign Application Priority Data

Sep. 14, 1982 [JP] Japan ..... 57-138381

[51] Int. Cl.[3] ..... B63H 9/04

[52] U.S. Cl. ..... 114/106

[58] Field of Search ..... 114/39, 90, 102, 103, 114/106, 107, 108

[56] References Cited

U.S. PATENT DOCUMENTS 3,132,620 5/1964 Court ..... 114/102
4,149,482 4/1979 Hoyt ..... 114/106

FOREIGN PATENT DOCUMENTS 1921682 11/1970 Fed. Rep. of Germany ..... 114/102
1409740 7/1965 France ..... 114/102
WO80/01787 9/1980 PCT Int'l Appl. ..... 114/90

*Primary Examiner*—Trygve M. Blix
*Assistant Examiner*—Jesûs D. Sotelo
*Attorney, Agent, or Firm*—W. Thad Adams, III

[57] ABSTRACT

A sailboat has a rotatable mast having a pivot mast for holding a sail and a slat member broadening backward from a leading edge to have a streamline section of a wing section together with the pivot mast and arranged along the pivot mast. The mast is rotated to be fixed at a desired position. Not only the sail but also the slat member produces a lift. The production of vortex and exfoliation of laminar layer are suppressed. Reefing and folding of the sail is facilitated.

4 Claims, 8 Drawing Figures

SAILBOAT

BACKGROUND OF THE INVENTION

The present invention relates to a sailboat and more particularly to a sailboat having a rotatable mast which spreads out a main sail and the other sails so that the mast itself can share a part of a wing-shaped leading edge for producing a dynamic lift.

Sailing vessels have a long history. Once the most commonly used was a four-sided sail spreading between a boom and a spar sticking abaft the upper point of the mast, until recent technical developments of sailing have brought about the Marconi rig with a tall triangle-shaped sail. Nowadays the most popular sails are equipped in such a way that the luff, i.e. the front side of the mainsail is led to a groove formed along the back side of the mast, while the foot of the mainsail is led to a groove formed along the upper edge of the boom.

In other words, in a sailing vessel thus equipped, for example a yacht, the sail not only becomes easier to handle but also enables more efficient sailing by spreading the sail between the mast and the boom in an ideal shape. This is the reason for its popularity among racers.

FIG. 1 shows an example of a mast used on existing yachts equipped as described above. A mast 1 is in the form of a pipe and has a hollow space 2 in consideration of the need of light weight and strength. Generally the mast 1 has an integrated unit with taper made of laminated wood, light metals and plastic materials. Reference numeral 3 denotes a groove provided along the back side of the mast 1. The groove 3 is narrow-mouthed to prevent the front part 5A of a sail 5, with the luff rope 4 contained inside of the groove 3, from flying out.

Thus, when setting the sail, a downward pull at the main halyard installed through a pulley at the top of sail 5 lifts the front side 5A of the sail 5 to the top of the mast 1 along the groove 3.

However, in the prior mast 1 thus constructed, the mast 1 is fixedly mounted to the hull of the sailboat and accordingly the direction of the mast 1 is not variable. As a result, the lift in the sail 5 that bears a driving force works only in a portion of the sail 5 that spreads backward from the groove 3, and the mast 1 itself does not contribute to the lift.

Moreover, depending on the directions of a wind and the sail 5, complex vortex and/or exfoliation of a laminar layer can be formed behind the mast 1 and the sail 5, reducing lift, sometimes resulting in a stall.

Furthermore, in case of reefing or folding the sail, although some sails are designed to be rolled around the boom, usually this is a hard work without a proper equipment.

SUMMARY OF THE INVENTION

With the above in view, it is an object of the present invention to provide a sailboat in which these problems are solved to contribute to obtain a dynamic lift for the sail and also to make reefing or folding of the sail easier.

In order to attain this object, a sailboat according to the present invention has a rotatable mast including a member which has a section corresponding to a fore portion of a wing-shape with a leading edge such as a streamline shape on a bow side of the mast which is opposite to the side holding the extended sail plane.

A wrapping-sail can be installed so that its front side is wrapped by turning the cylindrical pivot mast, if needed.

Moreover, a lower supporting member of the thus constructed mast has a driving gear that turns the mast, so that the sail can be wrapped around the mast by the driving gear and the mast can be fixed at a desired rotating position, if required.

DETAILED DESCRIPTION OF THE PREFERRED EMBODIMENTS

Figure 1:
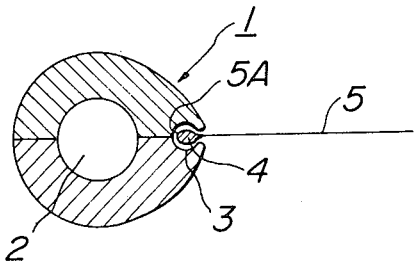
FIG. 1 PRIOR ART
FIG. 1 is a sectional view showing a relationship between a mast and the front part of a sail in a conventional yacht.
Figure 2:
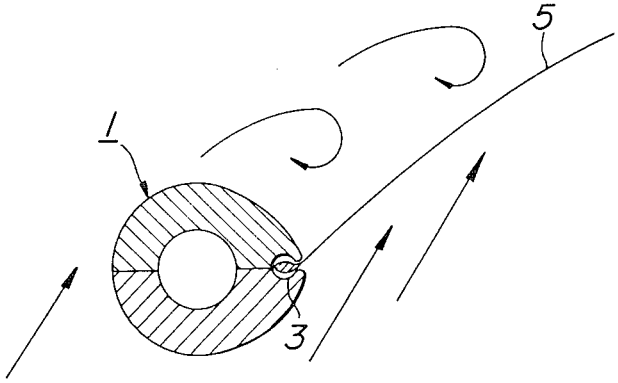
FIG. 2 PRIOR ART
FIG. 2 is an explanatory diagram illustrating an example of a condition of a wind flow caused along the sail shown in FIG. 1 in accordance with a direction of the wind.
Figure 3A:
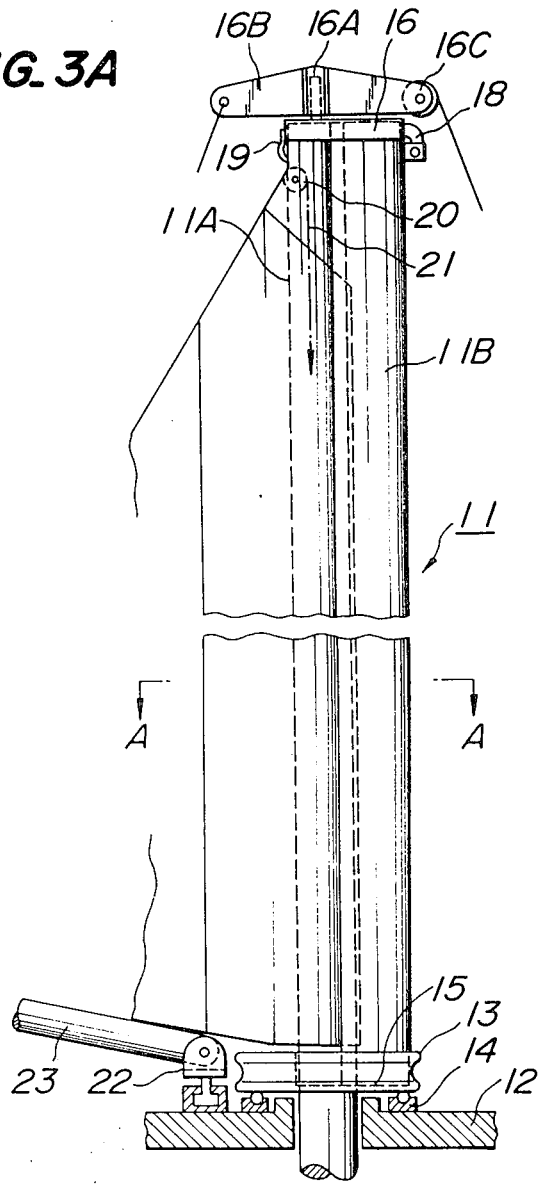
FIG. 3A is a side view showing an embodiment of a mast in a sailboat according to the present invention.
Figure 3B:
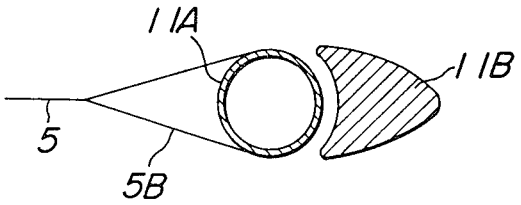
FIG. 3B is a sectional view taken along line A—A.

FIGS. 3A and 3B show one embodiment of a sailboat according to the present invention. Here, reference numeral 11 denotes a mast constructed by a combination of a cylindrical pivot mast 11A and a slat part 11B installed on the bow side of the mast 11A. The pivot mast 11A bears its share of the strength as the mast 11 itself, while in this embodiment a wrapping-sail part 5B is installed in a manner that this wrapping-sail part 5B is wrapped around the pivot mast 11A which is rotatably supported by a deck 12 and a hull (not shown).

Figure 4:
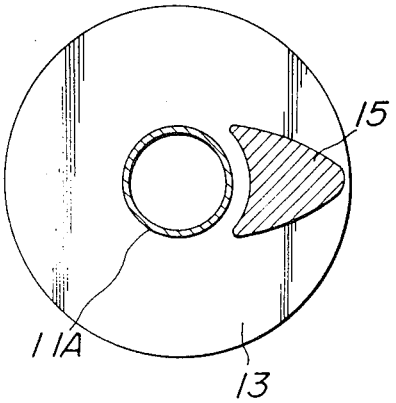
FIG. 4 is a plan view showing a supporting base of the mast shown in FIG. 3A.
Figure 5:
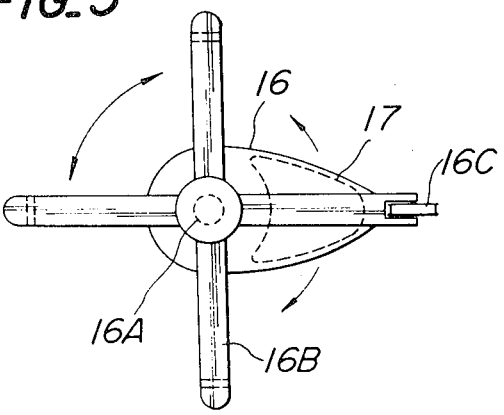
FIG. 5 is a top view showing a masttop and a masttop cap.

Reference numeral 13 denotes a lower supporting base through which the foot of the pivot mast 11A is inserted into the deck 12, and 14 a thrust bearing provided between the lower supporting base 13 and the deck 12. As seen in FIG. 4, formed on the upper surface of the base 13 is recess 15 into which the foot of the slat member 11B is inserted to support the slat member 11B. Also, the top of the mast 11 is covered by a masttop cap 16 having a recess for supporting the top of the slat member 11B, s seen in FIG. 5. Accordingly, when assembling the mast 11, the foot of the slat member 11B should first be inserted into the recess 15, and then the tops of the pivot mast 11A and the slat member 11B are aligned, so that masttop cap 16 is placed to cover both of the pivot mast 11A and the slat member 11B.

In this embodiment, the masttop cap 16 is connected to the pivot mast 11A by a hinge 18, with which the masttop cap 16 is detachably mounted on the masttop.

Reference numeral 19 indicates a metal fastener, for example, in the form of a spring. When the masttop cap 16 covers the masttop, the fastener 19 secures the pivot mast 11A tightly enough to hold the slat member 11B.

Moreover, the masttop cap 16 has a cross-bar 16B for setting stays. The cross-bar 16B is rotatable around a shaft 16A of the cap 16, so that the mast 11 can freely rotate with the stays attached to the cross-bar 16B. Further, reference numeral 16C indicates a pulley for a jibsail (not shown).

In FIG. 3A reference numeral 20 denotes a pulley for drawing up a main halyard 21, and 22 a supporting member for a boom 23. This supporting member 22 is installed on the deck 12 and enables the boom 23 to swing either rightwards or leftwards, or upwards or downwards.

Figure 6:
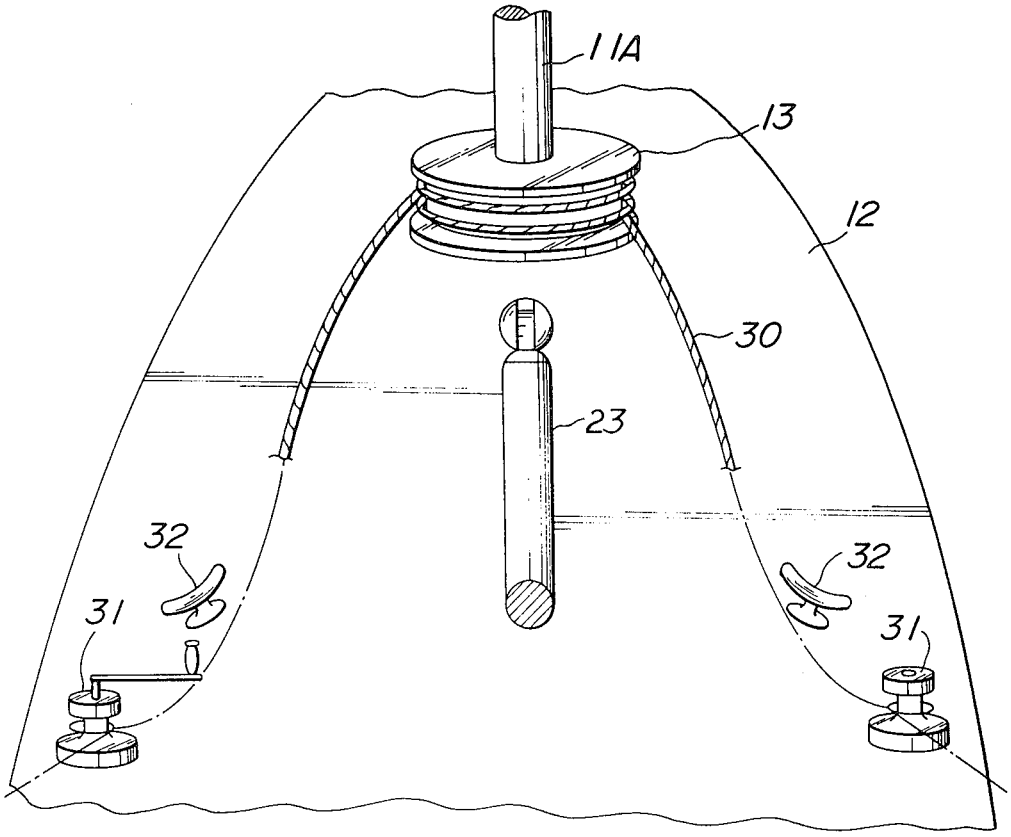
FIG. 6 is a perspective view showing an embodiment in which a member for turning the mast and a member for fixing the turned mast are arranged on a deck.

FIG. 6 shows an embodiment of means for rotating the mast 11 in the present invention. A rope 30 is wound around the lower supporting base 13. The rope 30 is strained toward the both sides of the board by winches 31 provided at the both sides. Thus the mast 11 can be turned by the winches 31 and cleated by cleats 32 or cam cleats (not shown) at a desired position.

Further, the winches 31 and the cleats 32 are generally equipped for handling the jibsail, so that they can serve also for the purpose of turning the mast 11, or additional winches and cleats can be equipped, if needed.

Because the mast 11 can be turned in this way, reefing and folding of the sail 5 can also be performed easier by winding the sail 5 around the mast 11.

When the rope 30 is released from cleating condition to let the mast 11 rotatable, both the sail 5 and the mast 11 can adjust themselves to the best sailing condition as follows.

Figure 7:
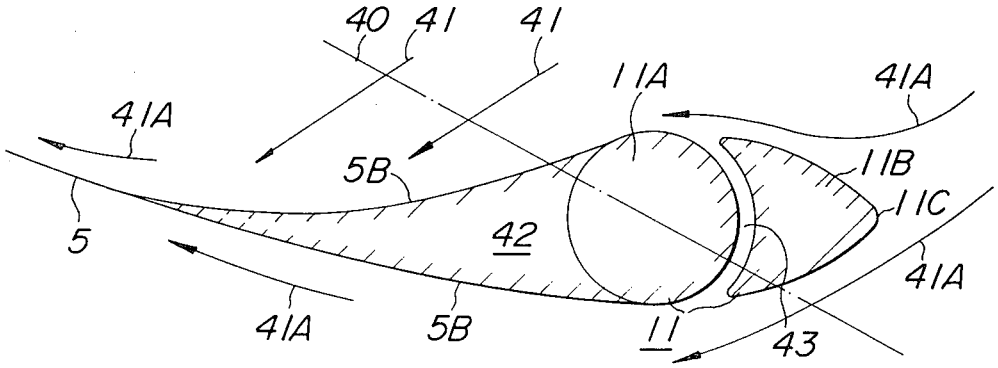
FIG. 7 is an explanatory diagram showing an example of a condition of a wind flow caused along the sail in accordance with a direction of the wind in a sailboat according to the present invention.

First, explained with reference to FIG. 7 is a dynamic lift that can be obtained by the sail 5 and the mast 11 thus constructed when sailing. In FIG. 7, reference numeral 40 indicates a center line of the vessel, 41 a wind direction, and 41A streamlines showing how the wind flows around the mast 11, the sail 5 and the wrapping-sail 5B.

Under these conditions, the portion from the leading edge 11C at the top of the slat member 11B to the wrapping sail 5B works as a part of the sail 5, and a wing shape 42 thus formed by the slat member 11B, the pivot mast 11A and the wrapping-sail 5B forms a laminar flow such as indicated by a streamline 41A along the wind shape 42, so that the production of vortex and the exfoliation of laminar layer are prevented, as well.

Needless to say, a dynamic lift thus obtained from the wing shape 42 is aerodynamically efficient. Moreover, a slot 43 is formed between the pivot mast 11A and the slat member 11B in the present invention, so that the slot 43 is useful for arranging the flow, especially effective to suppress a stall at a large angle of incidence.

As explained above, according to the present invention, there is provided a rotatable mast having a pivot mast for holding a front part of a sail and a slat member installed along and on the side of the pivot mast opposite to the front part of the sail to form a wing-shaped leading edge, so that the mast turns the leading edge to direct against a wind, following a direction that the sail is stretched. As a result, the slat member can not only produce a lift but also suppress possible formation of vortex or exfoliations of laminar layer around the sail or the mast. In addition, a member for rotating the mast or a member for fixing the mast may be provided to facilitate reefing and folding of the sail.

In addition, if a sail has a wrapping-sail wound around the pivot mast, the wrapping-sail and the mast can work together to form a smoother wing section thereby to enhance a lift.

While in the above explanation, the pivot mast and the slat member has a hollow cylindrical section and a solid spindle section, respectively, the sections of the pivot mast and the slat member are not limited to them. For example, an oval or spindle section is possible for the pivot mast, while the slat member can have a plate section with streamlined profile. It is sufficient that the combination of the pivot mast and the slat member forms a substantially streamlined section, which is a front part of wing section.

Although in the above embodiment, these various sections appear not to change their sizes from the mast-top to the deck, they can also be tapered toward the masttop to decrease top-heavy of vessel.

Moreover, while in the above embodiment, the rope is wound around the mast-supporting base by the winches to fix the mast at a desired rotational position by the cleats, the member for turning and fixing the mast are not limited to the winches and the cleats and can also be different means as long as they allow the mast to rotate freely and to stop at a desired position.

Furthermore, the positions at which the members for turning and fixing the mast can be installed either on or below the deck, depending on the convenience of handling.

What is claimed is:

1. A sailboat comprising:

(a) rotatable mast having a pivot mast for holding the front part of a sail, and for winding said sail therearound and a slat member broadening backward from a leading edge to have a section corresponding to a fore portion of a wing section working together with said pivot mast and arranged along said pivot mast;

(b) base for rotatably supporting said pivot mast and said slat member, said slat member being detachably mounted on said base; and (c) means for rotating said base around the axis of said pivot mast, so that said mast can be directed to a direction of maximum lift and for fixing said base after the rotation at a desired position.

2. A sailboat as claimed in claim 1, wherein said slat member is provided on the side of said pivot mast opposite to the side that the expanded surface of said sail is held.

3. A sailboat as claimed in claim 1, wherein said slat member and said pivot mast form a streamline section.

4. A sailboat as claimed in claim 1, wherein said sail has a wrapping sail as said front part of said sail.

* * * * *